US008312575B1

(12) United States Patent
Maraj

(10) Patent No.: US 8,312,575 B1
(45) Date of Patent: Nov. 20, 2012

(54) PROTECTIVE CRIB LINER FOR CHILD DEVELOPMENT

(76) Inventor: Bobby Maraj, New Haven, CT (US)

( * ) Notice: Subject to any disclaimer, the term of this patent is extended or adjusted under 35 U.S.C. 154(b) by 0 days.

(21) Appl. No.: 13/209,527

(22) Filed: Aug. 15, 2011

(51) Int. Cl.
*A47D 15/00* (2006.01)

(52) U.S. Cl. ..... 5/93.1; 5/663; 5/946

(58) Field of Classification Search ..... 5/663, 93.1, 5/424, 427, 946, 425, 426
See application file for complete search history.

(56) References Cited

U.S. PATENT DOCUMENTS

| | | | | |
|---|---|---|---|---|
| 4,767,419 | A | 8/1988 | Fattore | |
| 5,881,408 | A * | 3/1999 | Bashista et al. | 5/663 |
| 5,926,873 | A * | 7/1999 | Fountain | 5/424 |
| 5,937,458 | A * | 8/1999 | DeRosa | 5/424 |
| 6,170,101 | B1 * | 1/2001 | McCloud | 5/424 |
| 6,523,608 | B1 * | 2/2003 | Solbrekken et al. | 165/185 |
| 6,564,403 | B1 | 5/2003 | Titus | |
| 7,003,821 | B2 | 2/2006 | DeHart et al. | |
| 7,003,823 | B1 | 2/2006 | Reed et al. | |
| 7,523,513 | B2 | 4/2009 | Waters et al. | |
| 7,694,364 | B1 * | 4/2010 | Toma | 5/424 |
| 2001/0000362 | A1 * | 4/2001 | Wagner et al. | 5/424 |
| 2002/0018601 | A1 * | 2/2002 | Nelson | 383/7 |
| 2003/0177575 | A1 * | 9/2003 | Cheng et al. | 5/93.1 |
| 2006/0253979 | A1 * | 11/2006 | Chen | 5/93.1 |
| 2007/0061961 | A1 * | 3/2007 | Shamie | 5/93.1 |
| 2009/0313762 | A1 | 12/2009 | Boutwell | |
| 2011/0113552 | A1 * | 5/2011 | Miller | 5/424 |

* cited by examiner

*Primary Examiner* — William Kelleher
(74) *Attorney, Agent, or Firm* — Lyman H. Moulton, Esq

(57) ABSTRACT

A protective crib liner for a child includes a full protective liner configured to surround an inner length and height of the crib and to wrap-around a top perimeter portion of the crib. Up to eight fasteners may be affixed to the liner to secure it to the crib. Tethers attach child development items to the liner and extend through the liner to tie around a portion of the crib. The items are attached at various heights to stimulate the child's mind, motor functions and senses. A pocket hanger attaches to the top of the liner and hangs on a top perimeter of the crib to secure the pocket hanger and the liner to the crib. A method facilitating the child's development includes attaching the development items inside the liner at various heights the child may reach thereby encouraging the child to move up, down and across in the crib.

18 Claims, 6 Drawing Sheets

PROTECTIVE CRIB LINER FOR CHILD DEVELOPMENT

BACKGROUND OF THE INVENTION

Baby crib bumpers and playpen liners come in many sizes and shapes. Protective liners protect babies and small children from the underlying wooden, metallic and otherwise hard structures and even prohibit siblings from poking sharp objects into the playpen. Crib liners also prohibit children from extending and getting their limbs caught between crib slats during sleep and slumber. Crib bumpers or rail guards also prohibit children from chewing on crib rails and ingesting harmful and toxic chemicals. Crib bumpers and playpen liners are therefore useful and often necessary for the proper care of babies and small children.

However, many liners may isolate a child from his or her surrounding environment. Some liners may even obstruct a child's view of his or her surroundings that otherwise are visible through the crib or playpen slats. Studies performed by neuroscientists have shown that children need stimulus and interaction to properly develop mentally and physically. They have shown that a child's brain is extremely impressionable and has a high degree of 'plasticity' to learning events and enriching stimuli. However, this plasticity has both a positive and a negative side. On the positive side, children's brains are able to retain a variety of experiences and learn quickly. On the negative side, it also means that young children's brains are more vulnerable to developmental problems should their environment prove especially impoverished or un-nurturing.

Therefore, a market and a long felt need exists for a protective crib and playpen liner which not only protects a child from the hard and damaging underlying structures of a crib or playpen but also provides enriching stimulus and learning events for the proper mental and physical development of the child placed therein.

SUMMARY OF THE INVENTION

A protective crib liner for a child's crib and a child as disclosed comprises a full protective liner configured to surround an inner length and height of the crib. The crib liner is also configured to wrap-around a top perimeter portion of the crib. The crib liner may be comprised of a quilted fabric, a flexible padded material and any other fabric and/or material configurable to cushion a child from the crib panels. Up to eight fasteners are affixed to the protective liner in eight places to secure the liner to the crib. A plurality of tethers is also included. Each tether is configured to attach a development item to the liner and extend through the liner to tie around a portion of the crib. Child development items are attached to an inside of the protective liner at a plurality of heights on the liner to stimulate a child's mind, motor functions and senses. A pocket hanger comprises at least two semi-rigid hangers configured to attach the pocket hanger to the protective crib liner at a top of the liner and hangs on a top perimeter portion of the crib. The semi-rigid hangers are configurable to the shape of the top perimeter of the crib and thereby secure the pocket hanger and the liner to the crib. The pocket hanger comprises a plurality of pockets to hold a product to assist a caregiver in giving care to a child.

A method for facilitating the development of a child in a crib is also disclosed. The disclosed method comprises securing to the crib a full protective liner configured to surround an inner length and height of the crib and wrap-around a top perimeter portion of the crib. The method also comprises providing a plurality of child development items configured to attract a child's senses and attaching the development items on an inside of the crib liner via the tethers at a plurality of locations to encourage the child to move up, down and across in the crib. The disclosed method additionally comprises attaching at least one child development item on an inside of the protective crib liner at a height the child may reach laying down, at a height the child may reach sitting up and at a height the child may reach standing up.

Other aspects and advantages of embodiments of the disclosure will become apparent from the following detailed description, taken in conjunction with the accompanying drawings, illustrated by way of example of the principles of the disclosure.

Figure 1:
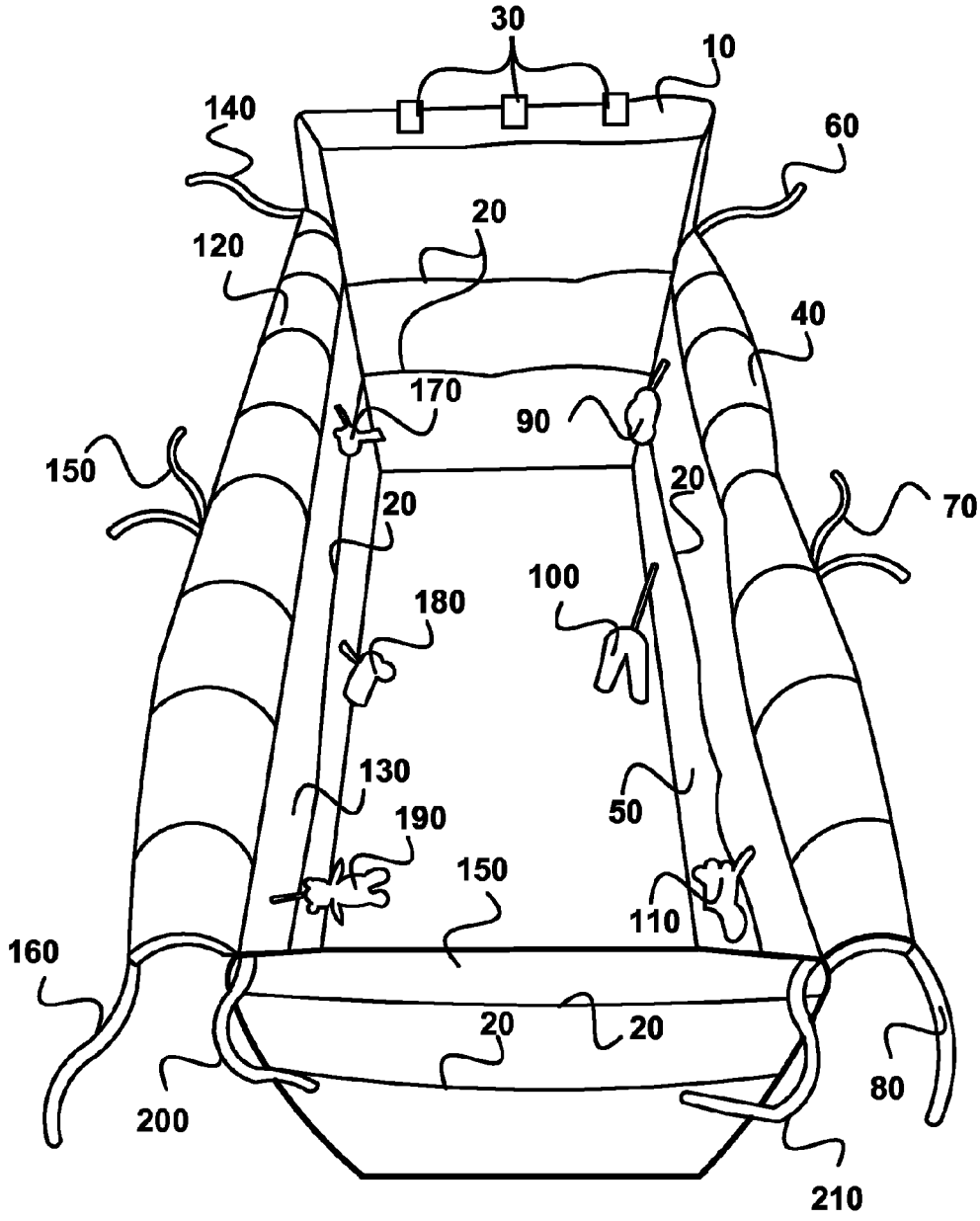
FIG. 1 is a top perspective view of a protective crib liner for child development in accordance with an embodiment of the present disclosure.

Throughout the description, similar reference numbers may be used to identify similar elements in the several embodiments and drawings. However, the utility of similar elements having similar reference numbers in the various embodiments of the disclosure are not to be restricted to one embodiment or another as depicted and detailed herein.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

As used throughout the present disclosure, the term 'crib' is inclusive of a baby's bed but also includes a playpen and other enclosures or structures used for the care and maintenance of a child. Also, the term 'development item' used throughout the disclosure is inclusive of a baby's toy, but also more broadly comprises other items such as books, whistles, snacks, containers, music speakers, microphones, scented small pillows, etc. which may stimulate a child's senses and mind.

FIG. 1 is a top perspective view of a protective crib liner for child development in accordance with an embodiment of the present disclosure. The protective crib liner depicted includes a head panel liner 10, a typical quilted line 20, a typical pocket hanger attachment 30 (3 each), a crib liner top 40, a crib liner first side 50, a first crib liner tie 60, a second crib liner tie 70 and a third crib liner tie 80, a first development item or toy 90, a second development item or toy 100 and a third development item or toy 110. The depicted crib liner also includes a second crib liner top 120, a crib liner second side 130, a fourth crib liner tie 140, a fifth crib liner tie 150 and a sixth crib liner tie 160, a forth development item or toy 170, a fifth development item or toy 180 and a sixth development item or toy 190. The depicted crib liner additionally includes a foot panel liner 150, a seventh crib liner tie 200 and an eight crib liner tie 210.

The protective crib liner for a child's crib and a child as disclosed comprises the first side panel 50, the second side panel 130, a head panel 10 and a foot panel 150. Each liner panel may be configured to the shape of a respective crib panel underneath. The crib liner panels may be contiguous or may be disparate but adjacent in order to fully surround an inner length and height of the crib. The crib liner may be comprised of a quilted fabric, a flexible padded material and any other fabric and/or material configurable to cushion a child from the crib panels. Each quilted liner panel is depicted with a quilted line or two typical of the quilted line 20.

Child development items or toys 90, 100, 110 and 170, 180 and 190 may be attached to an inside of the protective liner at a plurality of heights relative to a top of the liner to stimulate a child's mind, motor functions and senses. The development items may comprise toys of different colors, shapes, numbers, textures and any other characteristics designed to stimulate a child's mind, motor functions and senses.

Figure 2:
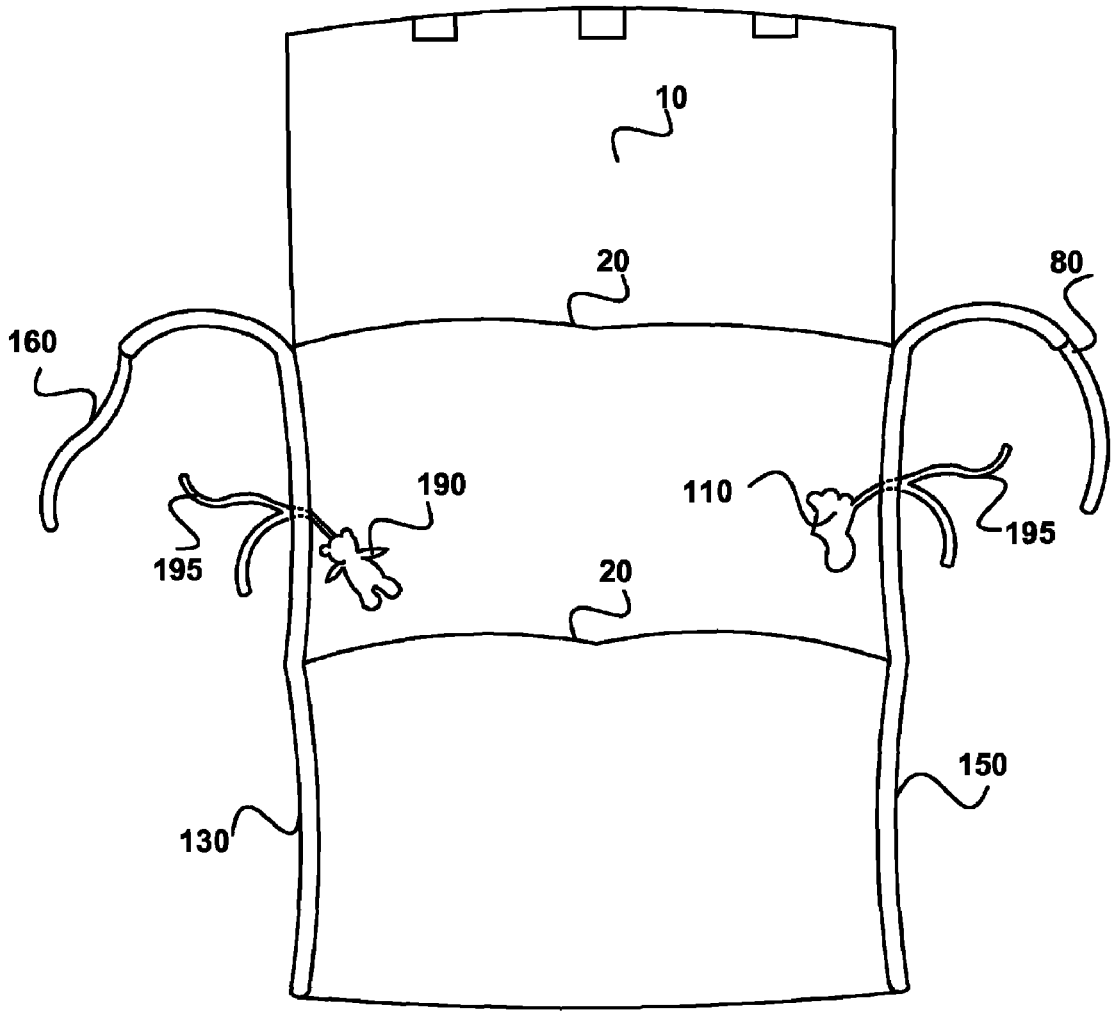
FIG. 2 is an end elevational view of the protective crib liner without the foot panel illustrating tethers for two development items in accordance with an embodiment of the present disclosure.

FIG. 2 is an end elevational view of the protective crib liner without the foot panel illustrating tethers for two development items in accordance with an embodiment of the present disclosure. The elements and features FIG. 1 above may be the same or similar in FIG. 2. A development item may be attached to the inside of the protective crib liner via a tether 195 attached to the liner. Tethers 195 may also extend through the liner to tie around a crib slat or other crib structure or crib hardware. A tether 195 may also comprise a highly flexible stranded wire where needed for electronic toys and development items placed inside the liner. The development items may be permanently or temporarily attached to an inside of the liner. A temporary attachment is used for an item too large for a child to swallow and a permanent attachment is used for an item small enough for a child to swallow. The temporarily attached items may therefore be replaced or moved to create variety over time for the child. The development items or toys may also be sewn into the liner, embossed onto or into the liner and embedded into the liner.

In an embodiment of the disclosure, at least one of the child development items is attached to the inside of the liner at a height the child may reach laying down. Another child development item may be attached at a height the child may reach sitting down or sitting up and other items may be reached by the child standing up. The attachment of toys or development items in various locations inside the crib liner encourages the child to explore, touch and interact with his or her environment.

Figure 3:
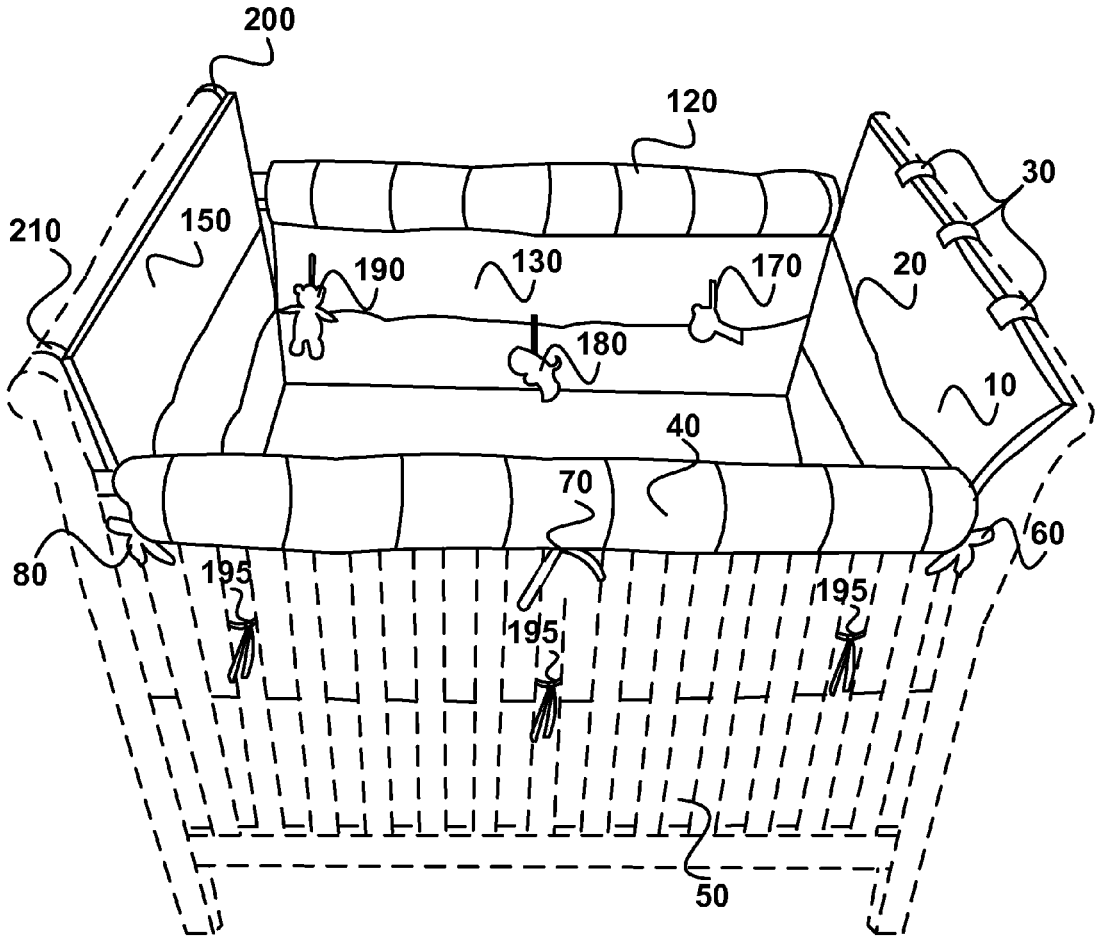
FIG. 3 is a top perspective view the protective crib liner for child development secured inside a crib in accordance with an embodiment of the present disclosure.

FIG. 3 is a top perspective view the protective crib liner for child development secured inside a crib in accordance with an embodiment of the present disclosure. The protective crib liner depicted includes a head panel liner 10, a typical quilted line 20, a typical pocket hanger attachment 30 (3 each), a crib liner top 40, a crib liner first side 50 seen between the slats of the crib, a first crib liner tie 60, a second crib liner tie 70, a third crib liner tie 80 and a plurality of tethers 195 configured to attach a development item to the liner and extend through the liner to tie around a crib slat. The depicted crib liner also includes a second crib liner top 120, a crib liner second side 130, a forth development item or toy 170, a fifth development item or toy 180, a sixth development item or toy 190, a foot panel liner 150, a seventh crib liner tie 200 and an eight crib liner tie 210. The first, second and third development items or toys 90, 100 and 110 are not in view in the present depiction. Also the fourth, fifth and sixth liner ties 140, 150 and 160 are not in view in the present depiction since they are tied to the crib underneath the wrap-around edge of the protective liner 150.

The crib liner is configured to wrap-around a top bar of each of the side panels. As depicted, the crib liner is configured to be flush with a top of the extended crib foot panel and the extended crib head panel. However, in embodiments where the crib foot panel and the crib head panel are not extended beyond a height of the side panels, the liner head and foot panels 10 and 150 may also wrap around a top bar thereof. The wrap-around feature of the present disclosure not only protects the top perimeter of the crib from a child's teeth but to also helps to secure the crib liner to the crib underneath and hides the ties or liner fasteners from the child's grasp.

The liner fasteners or ties may be attached to the liner in a middle of a length of the tie or at an end of the tie. The ends of the ties are wrapped around a crib or playpen slat or structure and knotted together to secure the liner to the crib. A grommet and tie pair may also be used where the grommet is disposed in the liner adjacent to the tie and the tie is configured long enough to wrap around a crib or playpen structure and pass through the grommet to be tied at the other side. Other fasteners such as snaps and hook and loop materials may also be used to secure the liner to the crib in up to eight places.

Figure 4:
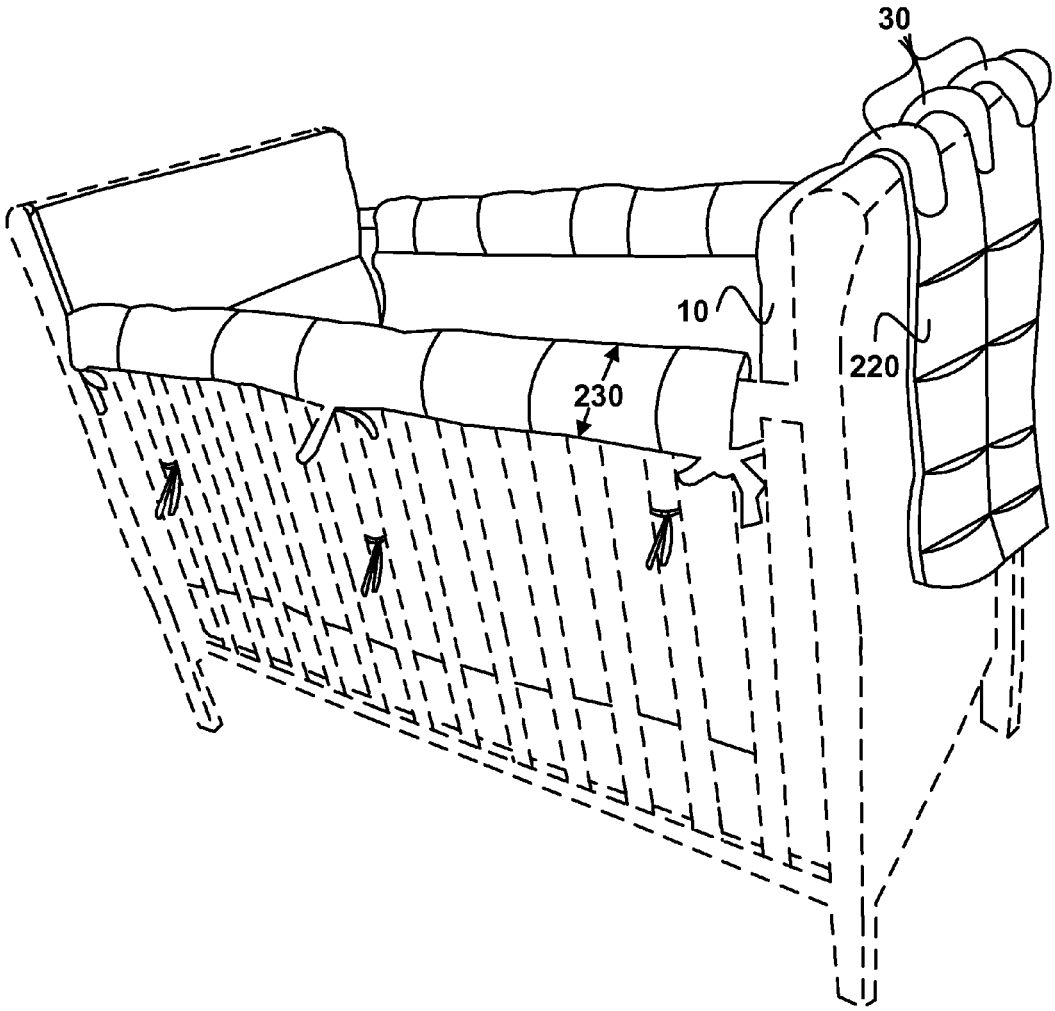
FIG. 4 is a side perspective view of the protective crib liner for child development placed inside a crib also depicting a pocket hanger in accordance with an embodiment of the present disclosure.

FIG. 4 is a side perspective view of the protective crib liner for child development placed inside a crib also depicting a pocket hanger in accordance with an embodiment of the present disclosure. In addition to the elements and features detailed above that are the same or similar in FIG. 4, a pocket hanger 220 is depicted. The pocket hanger 220 comprises at least two semi-rigid hangers 30 (three depicted) configured to attach the pocket hanger 220 to the protective crib liner at a top of the liner 10. The pocket hanger therefore hangs on a top perimeter portion of the crib. The semi-rigid hangers 30 are configurable to the shape of the top perimeter of the crib and thereby secure the pocket hanger 220 and the liner 10 to the crib. The pocket hanger 220 comprises a plurality of pockets to hold a product to assist a caregiver in giving care to a child. Products that may be held in the pocket hanger 220 include diapers drink bottles, hygiene products such as powder and ointment and any other product associated with care giving. The pocket hanger 220 provides a counter balance to the weight of the head panel 10 and thereby secures the liner head panel to the crib head panel. The pocket hanger 220 is depicted rectangular but the pocket hanger may also be square-like, oblong, elongate and any other shape comprising pockets. Also, the pocket hanger 220 is depicted with two columns of four rows of pockets but other configurations of columns and rows are also comprised including anything from a single column or row of large pocket to many smaller pockets.

Because up to eight fasteners may be affixed to the protective liner in up to eight places to secure the liner to the crib or playpen, setup and takedown of the liner is quick and easy. Also, because there are fewer fasteners in the to disclosure in contrast to the prior art, there are fewer potential entanglements for the child in the crib or playpen.

In an embodiment, a length 230 of the protective liner from the top perimeter portion of the crib to a wrap-around edge of the liner measures nominally 2.5 inches, minimally measures 1.5 inches and a maximum length measures approximately 4 inches to hide the crib and the fasteners from the child's sight and therefore the child's grasp.

The disclosed protective crib liner may prevent or at least discourage a child from chewing on portions of the crib. The protective liner also may protect the infant or child from direct contact with the crib during a fall therein. The protective liner for child development may also facilitate the child's motor and mental development through the placement of items and toys designed to stimulate the child's senses. The disclosed protective liner for child development therefore combines elements of safety with features of utility in a novel and unique way.

Figure 5:
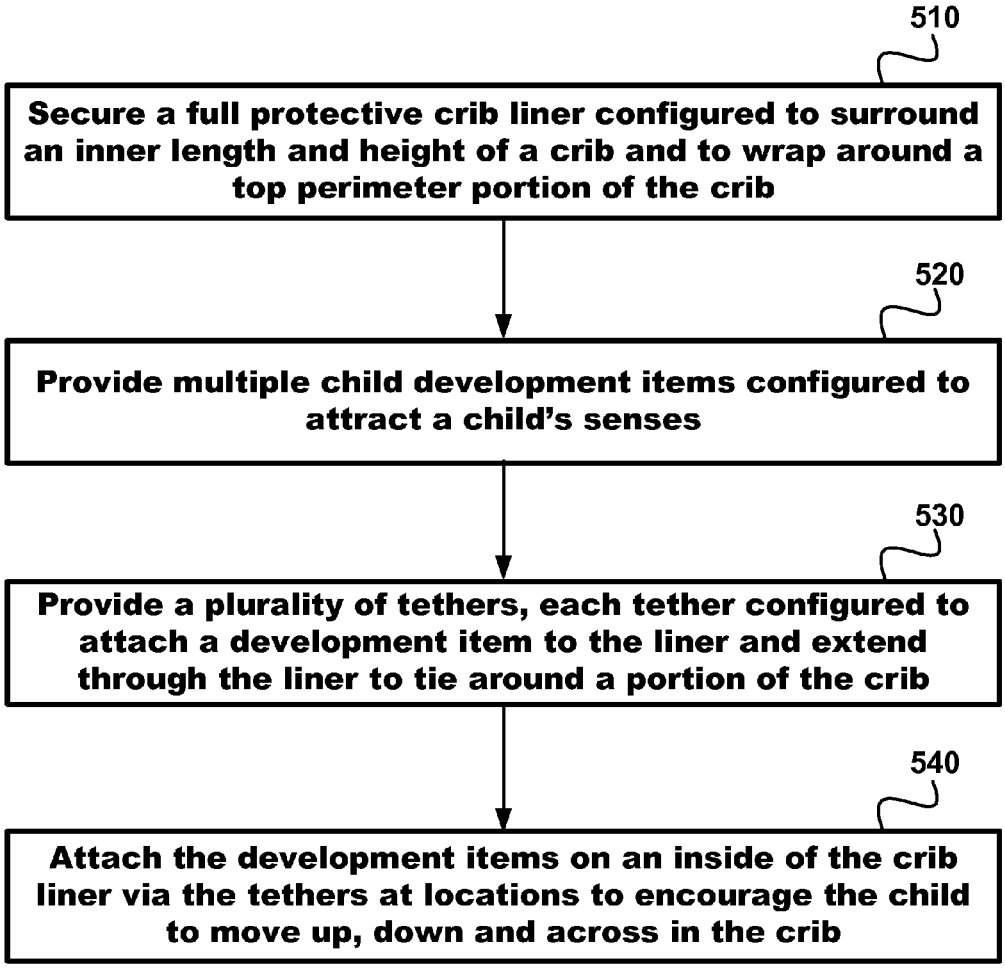
FIG. 5 is a flow chart of a method for facilitating the development of a child in a crib in'accordance with an embodiment of the present disclosure.

FIG. 5 is a flow chart of a method for facilitating the development of a child in a crib in accordance with an embodiment of the present disclosure. The disclosed method comprises securing 510 to the crib a full protective liner configured to surround an inner length and height of the crib and wrap-around a top perimeter portion of the crib. The method also comprises providing 520 a plurality of child development items configured to attract a child's senses. The method additionally includes providing 530 a plurality of tethers, each tether configured to attach a development item to the liner and extend through the liner to tie around a portion of the crib. The method further includes attaching 540 the development items on an inside of the crib liner via the tethers at a plurality of locations to encourage the child to move up, down and across in the crib.

Figure 6:
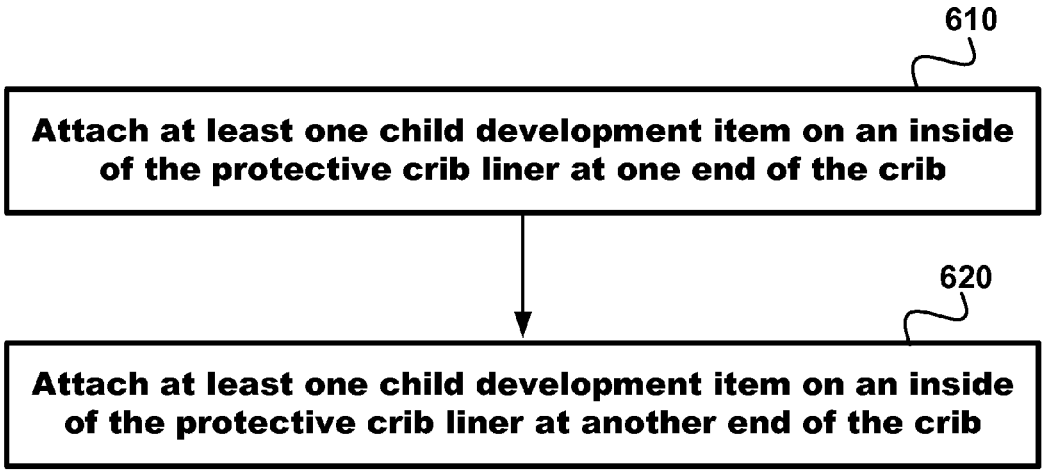
FIG. 6 is a flow chart of a method for encouraging the child to move across an inside of the crib in accordance with an embodiment of the present disclosure.

FIG. 6 is a flow chart of a method for encouraging the child to move across an inside of the crib in accordance with an embodiment of the present disclosure. The method includes attaching 610 at least one child development item on an inside of the protective crib liner at one end of the crib and attaching 620 at least another child development item on an inside of the protective crib liner at another end of the crib. The child may move across the crib from one end to the other in order to play with both the toys or to investigate the shapes, colors, textures, smells, sounds and tastes and other characteristics comprising the development items and thereby stimulate and develop his or her mind, motor functions and senses.

Figure 7:
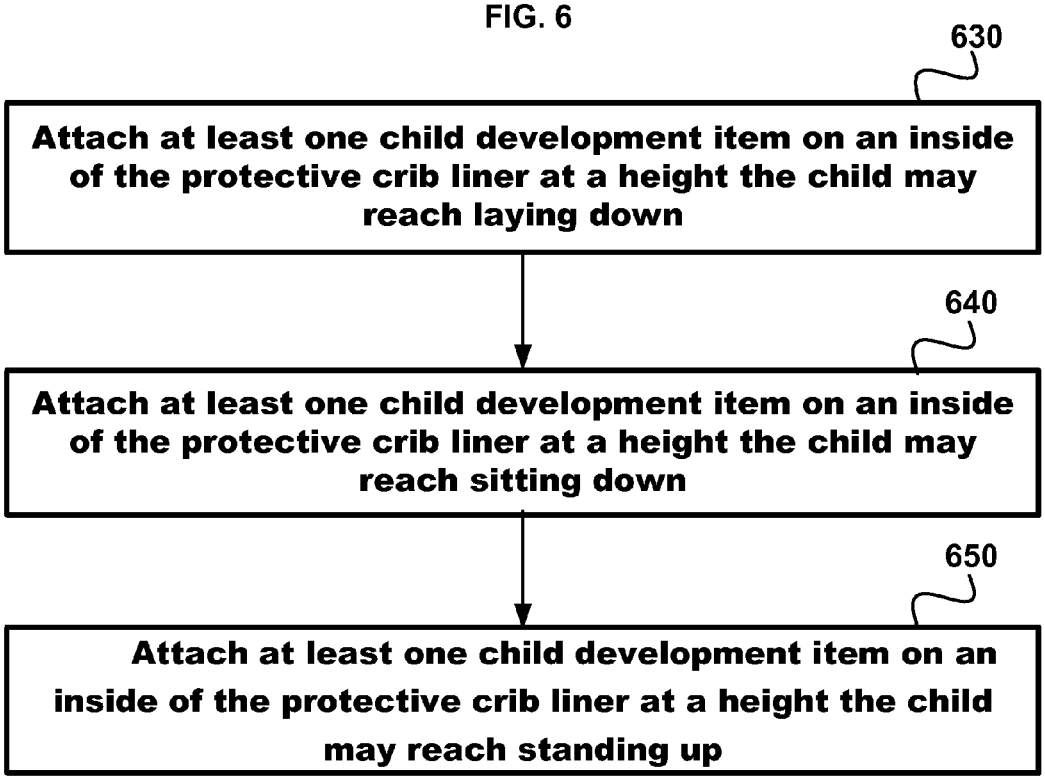
FIG. 7 is a flow chart of a method for encouraging the child to move up and down inside of the crib in accordance with an embodiment of the present disclosure.

FIG. 7 is a flow chart of a method for encouraging the child to move up and down inside of the crib in accordance with an embodiment of the present disclosure. The disclosed method comprises attaching 630 at least one child development item to or on an inside of the protective crib liner at a height the child may reach laying down. The method also includes 640 attaching at least another child development item on an inside of the protective crib liner at a height the child may reach sitting up. The method further includes attaching 650 at least one more child development item on an inside of the protective crib liner at a height the child may reach standing up. The disclosed method therefore encourages the child to seek out and explore the items or toys by moving vertically and horizontally up and down and across in the crib and thereby develop his or her motor functions.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

Notwithstanding specific embodiments of the invention have been described and illustrated, the invention is not to be limited to the specific forms or arrangements of parts so described and illustrated. The scope of the invention is to be defined by the claims and their equivalents.

What is claimed is:

1. A protective crib liner for a child's crib and a child, comprising:

a full protective liner configured to surround an inner length and height of the crib and configured to wrap-around a top perimeter portion of the crib;

a plurality of up to eight fasteners affixed to the protective liner in eight places, each fastener configured to secure the liner to the crib;

a plurality of tethers, each tether configured to attach a development item to the liner and extend through the liner to tie around a portion of the crib; and a plurality of child development items attached to an inside of the protective liner via the tethers at a plurality of heights from a top of the liner.

2. The protective crib liner of claim 1, wherein the protective liner is configured in a first and an opposing second side panel, a foot panel and a head panel, each liner panel configured to the shape of a respective crib panel.

3. The protective crib liner of claim 2, wherein the first and second liner side panels are configured to wrap around a top bar of each respective crib panel and a top of the liner foot panel and a top of the liner head panel are configured to secure flush with a top of the crib foot panel and a top of the crib head panel.

4. The protective crib liner of claim 2, further comprising a pocket hanger configured to hang from an outside top of the crib head panel in at least two places, the two places also affixed to the liner head panel, the pocket hanger comprising a plurality of pockets to hold at least one of a child diaper, a drink bottle, a hygiene product, a child toy and any other product to assist a caregiver in giving care to a child.

5. The protective crib liner of claim 4, wherein each of the first and second liner side panels comprise three fasteners and the liner foot panel comprises two fasteners and the pocket hanger provides a counter balance to the weight of the liner head panel and thereby secures the liner head panel to the crib head panel.

6. The protective crib liner of claim 1, wherein the plurality of child development items comprise toys of a plurality of colors, numbers, shapes, textures and other characteristics configured to stimulate the child's mind, motor functions and senses.

7. The protective crib liner of claim 1, wherein the plurality of heights for the child development items comprise a height the child can reach laying down, another height the child can reach siting down and another height the child can reach standing up.

8. The protective crib liner of claim 1, wherein a fastener comprises at least one of a tie attached to the liner in a middle of a length of the tie and a grommet and tie pair, the grommet disposed in the liner and the tie configured at least long enough to wrap around a portion of a crib side rail and a top bar and secure the liner to the crib.

9. The protective crib liner of claim 1, wherein the liner comprises a quilted fabric, a flexible padded material and any other fabric and/or material configurable to cushion a child from the crib panels.

10. A protective crib liner for a child's crib and a child, comprising:

a full protective liner configured to surround an inner length and height of the crib and configured to wrap-around a top perimeter portion of the crib;

a plurality of no more than eight fasteners affixed to the protective liner in eight places, each fastener configured to secure the liner to the crib;

a plurality of tethers, each tether configured to attach a development item to the liner and extend through the liner to tie around a portion of the crib; and a plurality of child development items disposed on an inside of the protective liner via the tethers at a plurality of heights from a top of the liner; and a pocket hanger configured to hang from an outside of the crib, the pocket hanger comprising at least one pocket for a caregiving item.

11. The protective crib liner of claim 10, wherein a length of the protective liner from the top perimeter portion of the crib to a wrap-around edge of the liner measures nominally 2.5 inches, minimally measures 1.5 inches and a maximum length measures approximately 4 inches to hide the crib from the child's sight.

12. The protective crib liner of claim 10, wherein the pocket hanger comprises at least two semi-rigid hangers configured to attach the pocket hanger to the protective crib liner at a top of the liner, the hanger also configured to hang on a top perimeter portion of the crib, the semi-rigid hangers configurable to the shape of the top perimeter of the crib and thereby secure the pocket hanger and the liner to the crib.

13. The protective crib line of claim 10, wherein the child development items disposed on the inside of the protective liner are one of attached to the liner, tethered to the liner, sewn into the liner, embossed onto the liner and embedded into the liner.

14. A method for facilitating the development of a child in a crib, comprising:

securing to the crib a full protective liner configured to surround an inner length and height of the crib and wrap-around a top perimeter portion of the crib;

providing a plurality of child development items configured to attract a child's senses;

providing a plurality of tethers, each tether configured to attach a development item to the liner and extend through the liner to tie around a portion of the crib; and attaching the development items on an inside of the crib liner via the tethers at a plurality of locations to encourage the child to move up, down and across in the crib.

15. The method for facilitating the development of a child in a crib of claim 14, wherein the plurality of child development items comprise toys of a plurality of colors, numbers, shapes, textures, smells, sounds, tastes and other characteristics configured to stimulate a child's mind, motor functions and senses.

16. The method for facilitating the development of a child in a crib of claim 14, further comprising:

attaching at least one child development item on an inside of the protective crib liner at one end of the crib; and attaching at least another child development item on an inside of the protective crib liner at another end of the crib.

17. The protective crib liner of claim 14, wherein the full protective liner is configured to wrap-around a top perimeter portion of the crib accessible to the child's mouth.

18. The method for facilitating the development of a child in a crib of claim 14, further comprising:

attaching at least one child development item on an inside of the protective crib liner at a height the child may reach laying down;

attaching at least another child development item on an inside of the protective crib liner at a height the child may reach sitting up; and attaching at least one more child development item on an inside of the protective crib liner at a height the child may reach standing up.

* * * * *